United States Patent [19]

Wolyn et al.

[11] 4,025,999

[45] May 31, 1977

[54] ADJUSTABLE CRIMP DIE ASSEMBLY

[76] Inventors: Joseph Wolyn, 7526 Woodland Terrace, Gurnee, Ill. 60031; Arthur J. Johnson, 324 Tupelo, Naperville, Ill. 60540

[22] Filed: Feb. 18, 1976

[21] Appl. No.: 659,001

[52] U.S. Cl. ..... 29/753; 29/788

[51] Int. Cl.[2] ..... H01R 43/04

[58] Field of Search ..... 72/417, 421; 29/203 D, 29/208 D, 203 DT, 203 DS

[56] References Cited

UNITED STATES PATENTS

| | | | |
|---|---|---|---|
| 3,091,276 | 5/1963 | Aquillon | 153/1 |
| 3,115,922 | 12/1963 | Straubel | 153/1 |
| 3,184,950 | 5/1965 | Sitz | 29/203 DS X |
| 3,204,334 | 9/1965 | Long et al. | 29/509 |
| 3,398,567 | 8/1968 | Olsson | 72/400 |
| 3,553,814 | 1/1971 | Rider | 29/203 DS |
| 3,747,190 | 7/1973 | Erlichman et al. | 29/203 D |
| 3,753,280 | 8/1973 | Blakeney et al. | 29/203 D |
| 3,833,993 | 9/1974 | Kremkau | 29/203 D |
| 3,872,584 | 3/1975 | Chick et al. | 29/203 DT X |
| 3,911,717 | 10/1975 | Yuda | 29/203 DS X |

*Primary Examiner*—John E. Roethel

[57] ABSTRACT

An adjustable crimp die assembly adapted to be mounted in a press for crimping a plurality of terminals onto stripped insulated wire leads. The crimp die assembly includes a base with a terminal supporting structure having a crimp station whereat a terminal is crimped onto a wire lead, punch asssembly opposite the crimp station, and a terminal feed assembly associated between the punch assembly and the terminals for feeding the terminals one at a time to the crimp station in response to the movement of the punch assembly. The crimp die assembly has an adjustable terminal feed assembly including a pawl member and a cam assembly operably associated between the punch assembly and the pawl member for moving the pawl member in response to the movement of the punch assembly whereby the terminals are fed to the crimp station. The cam assembly is changeable so as to change the distance the pawl member feeds the terminals to the crimp station. The punch assembly has an insulation crimp adjusting slide cam and a conductor crimp adjusting slide cam associated with an insulation punch and a conductor punch, respectively, so that the crimp height of each may be adjusted. The terminal supporting structure includes a removable module assembly mounted on the base and means for locating and locking the module assembly onto the base.

11 Claims, 5 Drawing Figures

ADJUSTABLE CRIMP DIE ASSEMBLY

BACKGROUND OF THE INVENTION

1. Field of the Invention

The present invention relates generally to crimp die assemblies adapted to be mounted in a press for crimping terminals onto stripped insulated wire leads. More particularly, the present invention relates to a crimp die assembly which is adjustable.

2. Brief Description of the Prior Art

Crimping machines have been found to be very useful for the purpose of effectively crimping a metal terminal or the like onto a stripped insulated wire lead. The crimping machine generally includes a crimp die assembly mounted on a bench press.

Ordinarily, terminals of the type which are commonly used are formed on a carrier strip adjacent to one another. The terminal strip is then fed into the crimp die assembly where each terminal is fed one at a time to a crimping station whereat the terminal is crimped onto a wire lead.

More specifically, most crimp die assemblies include a base with a terminal supporting structure for supporting the strip of terminals. The supporting structure has a crimp station whereat a terminal is crimped into the wire lead. The crimp station generally includes an insulation anvil and a conductor anvil. A punch assembly which forms a portion of the crimp die assembly is mounted opposite the crimp station and is operably connected to the press for reciprocal movement toward and away from the crimp station. The punch assembly includes an insulation punch and a conductor punch adapted to engage a wire lead and terminal at the crimp station. A crimp die assembly also includes a terminal feed assembly associated between the punch assembly and the terminals for feeding the strip of terminals one at a time to the crimp station in response to the movement of the punch assembly.

Very often, a manufacturer employing a crimping machine uses many different kinds of terminals and sizes of wire. In conventional crimping machine designs, whenever a different gaged wire is used or whenever a different shaped terminal is used, the whole crimp die assembly must be removed from the press and a new crimp die assembly is mounted in lieu thereof. Of course, the new crimp die assembly will have a different shaped conductor and insulation anvils and punches, as well as a different feeding distance increment which is performed by the terminal feed assembly.

In view of the variety of terminals and wires, manufacturers have had to stock various models of crimp die assemblies. This has proven to be very expensive.

SUMMARY OF THE INVENTION

The principle object of the present invention is to provide a crimp die assembly which is adjustable and had removable modular portions for permitting a wide range of terminal crimping capability at a low cost.

One feature of the present invention is to provide an improvement in the terminal feed assembly. The improved terminal feed assembly generally includes a pawl means movable in a sequence from a first position above the terminal strip to a second position engaging the strip away from the crimp area to a third position closer to the crimp area moving the strip therewith, and back to the first position. The distance between the second and third positions is defined as the progression distance between adjacent terminals on the strip so that successive terminals are presented to the crimp area one at a time. Associated between the punch assembly and the pawl means is an adjustable cam assembly. The cam assembly moves the pawl means in response to the movement of the punch assembly. The cam assembly has means for changing the relative configuration thereof which changes the progression distance of the pawl means movement between its second and third position to accomodate terminal strips of different progressions.

Another feature of the present invention is to provide an improved punch assembly for adjusting the crimp height of either the insulation crimp or the conductor crimp. The improved punch assembly includes an insulation crimp adjusting slide cam mounted above and movable transversely relative to the insulation punch. The insulation punch is allowed to crimp at a higher or lower height in response to the transverse movement of the insulation crimp adjusting slide cam.

The improved punch assembly also includes a conductor crimp adjusting slide cam mounted above and movable transversely relative to the conductor punch. The conductor punch is allowed to crimp at a higher or lower height in response to the transverse movement of the conductor crimp adjusting slide cam.

Still another feature of the present invention is a modular terminal supporting structure. This improved supporting structure generally includes a removable modular assembly mountable on the base and means for locating and locking the module assembly onto the base.

DESCRIPTION OF THE PREFERRED EMBODIMENT

I. GENERAL

Figure 1:
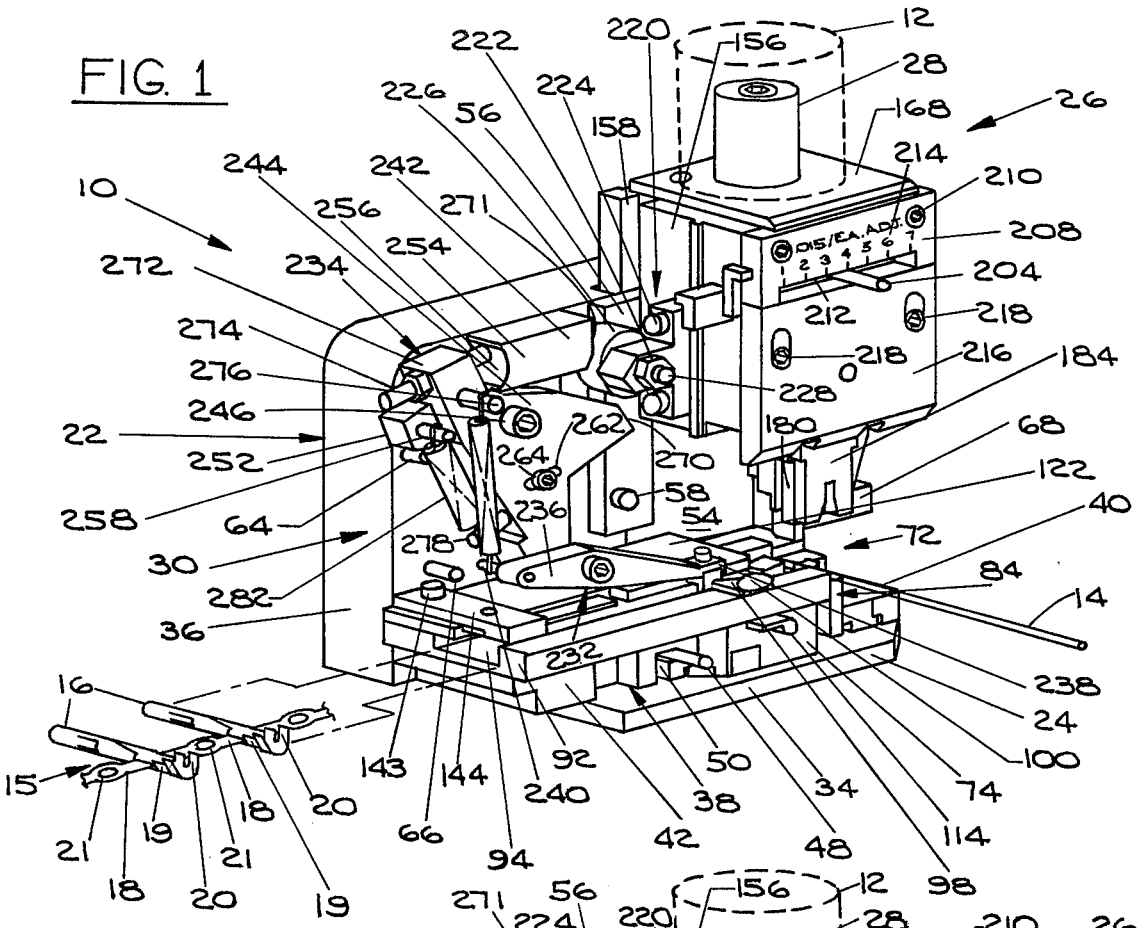
FIG. 1 is a perspective view of the crimp die assembly preparatory to crimping a terminal onto a wire lead.
Figure 2:
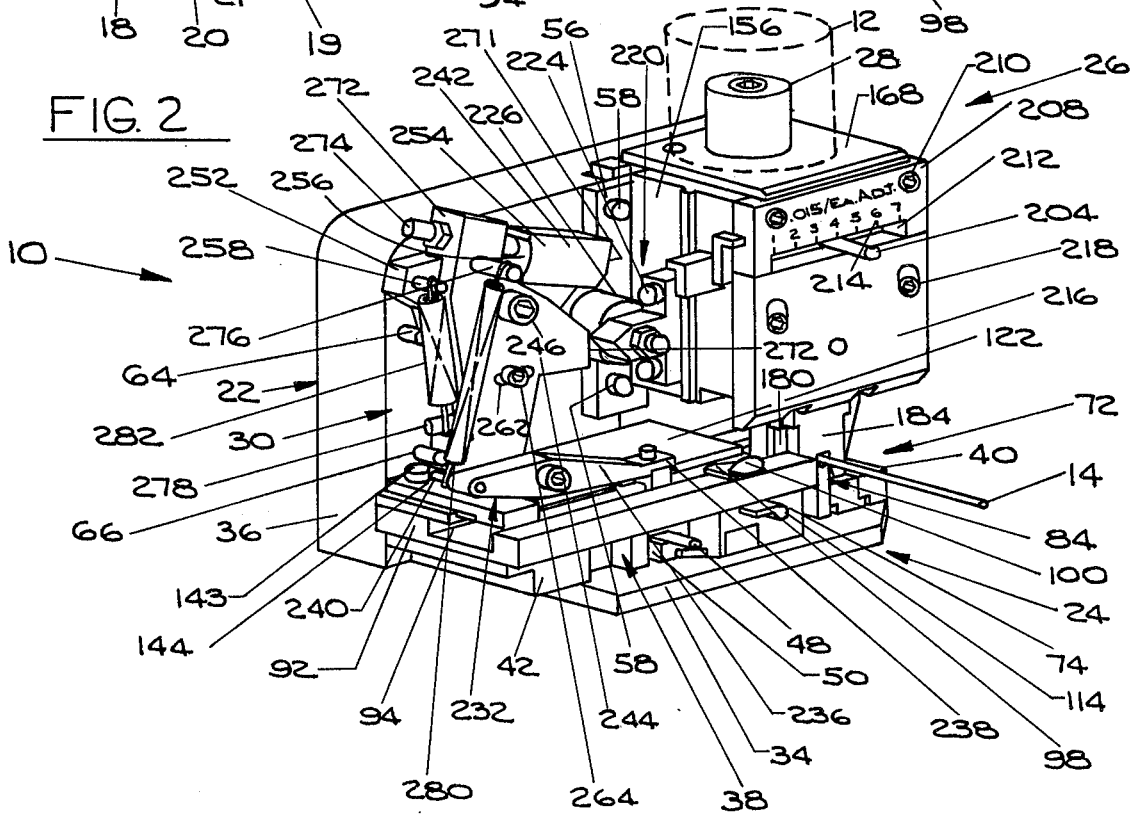
FIG. 2 is a perspective view of the crimp die assembly of the present invention during its crimping operation.

Turning now to FIGS. 1 and 2, a crimping machine employing an adjustable crimp die assembly, generally designated 10, is shown. The crimp die assembly is operably connected to a bench press 12 which is usually semi-automatic in operation.

Looking at FIG. 1, a terminal strip, generally designated 15, including a plurality of terminals 16 formed on a carrier strip 18 are fed into the crimp die assembly 10. Each terminal 16 has a conductor crimp section 19 and an insulation crimp section 20 which are adapted to be crimped about the conductor portion and insulation portion of the wire lead 14 respectively. The carrier strip 18 has an index hole 21 formed between each adjacent terminal 16 for purposes which will become more apparent hereinafter.

The terminal progression or the distance between adjacent terminals 16 varies from terminal to terminal. It is this distance that is significant when determining how the terminal strip 15 is fed into the crimp die assembly 10.

Figure 3:
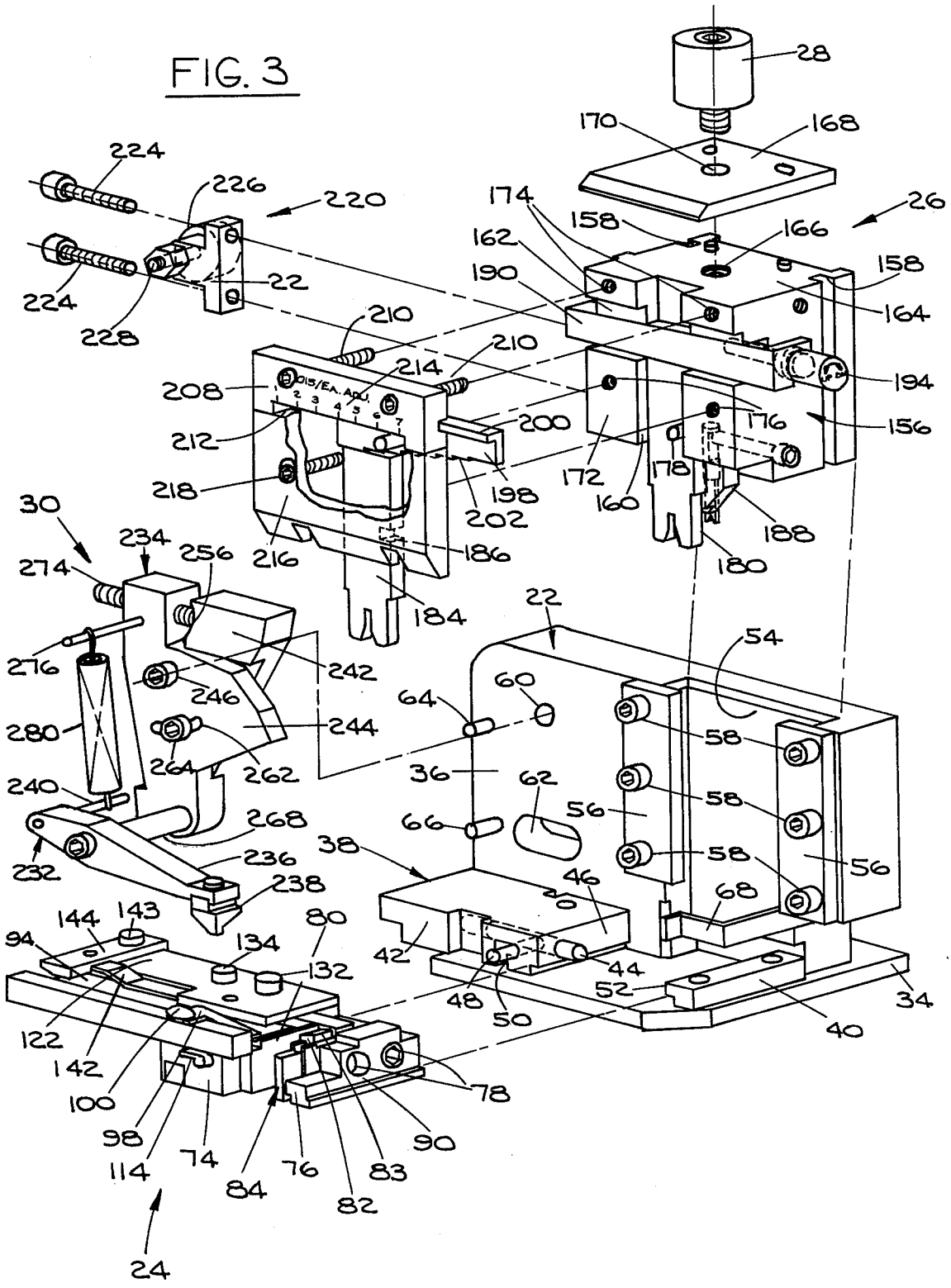
FIG. 3 is an exploded partially fragmentary perspective view of the crimp die assembly of the present invention.

Looking at FIGS. 1–3, the crimp die assembly is seen to generally include a frame assembly, generally designated 22, which forms the supporting structure for the crimp die assembly 10. A modular terminal support assembly, generally designated 24, is mounted on the frame assembly 22 and provides the support for the terminal 16 preparatory to the crimping operation. A punch assembly, generally designated 26, is movably mounted over the terminal support assembly 24 and is operably connected to the press 12 by means of an adaptor 28. Every time the press 12 is actuated by the operator, the punch assembly 26 moves downwardly toward the terminal support assembly 24 to crimp a terminal 16 onto a stripped insulation clad wire lead 14 as is illustrated in FIGS. 1 and 2.

A terminal feed assembly, generally designated 30, is mounted on the frame assembly 22 and is associated between the punch assembly 26 and the terminal strip 15 to feed the terminals 16 one at a time in response to the movement of the punch assembly 26. The terminal feed assembly 30 of the present invention is adjustable to accomodate terminals formed on a strip whose progression are of different distances.

II. FRAME ASSEMBLY

Turning now to FIG. 3 in greater detail, the frame assembly 22 is seen to generally include a horizontal base plate 34 having a vertical wall 36 extending upwardly therefrom. Mounted on the base plate 34 is a module locking assembly, generally designated 38 and a module locating bar 40 spaced from the locking assembly. The modular terminal support assembly 24 is adapted to be associated between the locking assembly 38 and the locating bar 40.

The modular locking assembly 38 includes a locking block 42 having a spring-loaded locating pin 44 normally extending out of a vertical mating surface 46. Extending out of the block 42 and perpendicularly formed on the pin 44 is an actuating rod 48. The actuating rod 48 extends out of the block 42 through an L-shaped slot 50 formed therein. The locating pin 44 is shown in its normal position in FIG. 3. However, if the actuating rod is manually moved horizontally and then downwardly in the L-shaped slot 50, no portion of the pin 44 will extend out of the block 42 at the mating surface 46.

The locating bar 40 is seen to include a ridge-like configuration facing the first mating surface 46 and defines a second mating surface 52. The two mating surfaces 46 and 52 are extended to abut surfaces on the terminal support assembly 24 when the terminal support assembly is mounted therebetween.

The vertical wall 36 has a relief portion 54 whereat the punch assembly 26 is mounted for movement. A pair of gibs 56 are secured to the wall 36 by means of a plurality of fasteners 58 to form a channel between the gibs and the wall 36 thereby capturing a portion of the punch assembly 26 therebetween.

The vertical wall 36 also includes an upper circular opening 60 and below that an oblong opening 62 for receiving portions of the terminal feed assembly 30 therethrough. In addition, wall 36 has an upper stop pin 64 and a lower stop pin 66 which cooperate with portions of the terminal feed assembly 30 as will be discussed in greater detail hereinafter.

A wire stop 68 is mounted on the wall 36 adjacent the relief portion 54 thereof. The wire stop 68 provides a physical means of determining how far a wire lead 14 should be inserted in the crimp die assembly 10 preparatory to the crimping operation.

III. MODULAR TERMINAL SUPPORT ASSEMBLY

The terminal support assembly 24 is adapted to be located between the locking block 42 and the locking bar 40. The module assembly 24 is then removably locked therebetween.

Figures 4, 5:
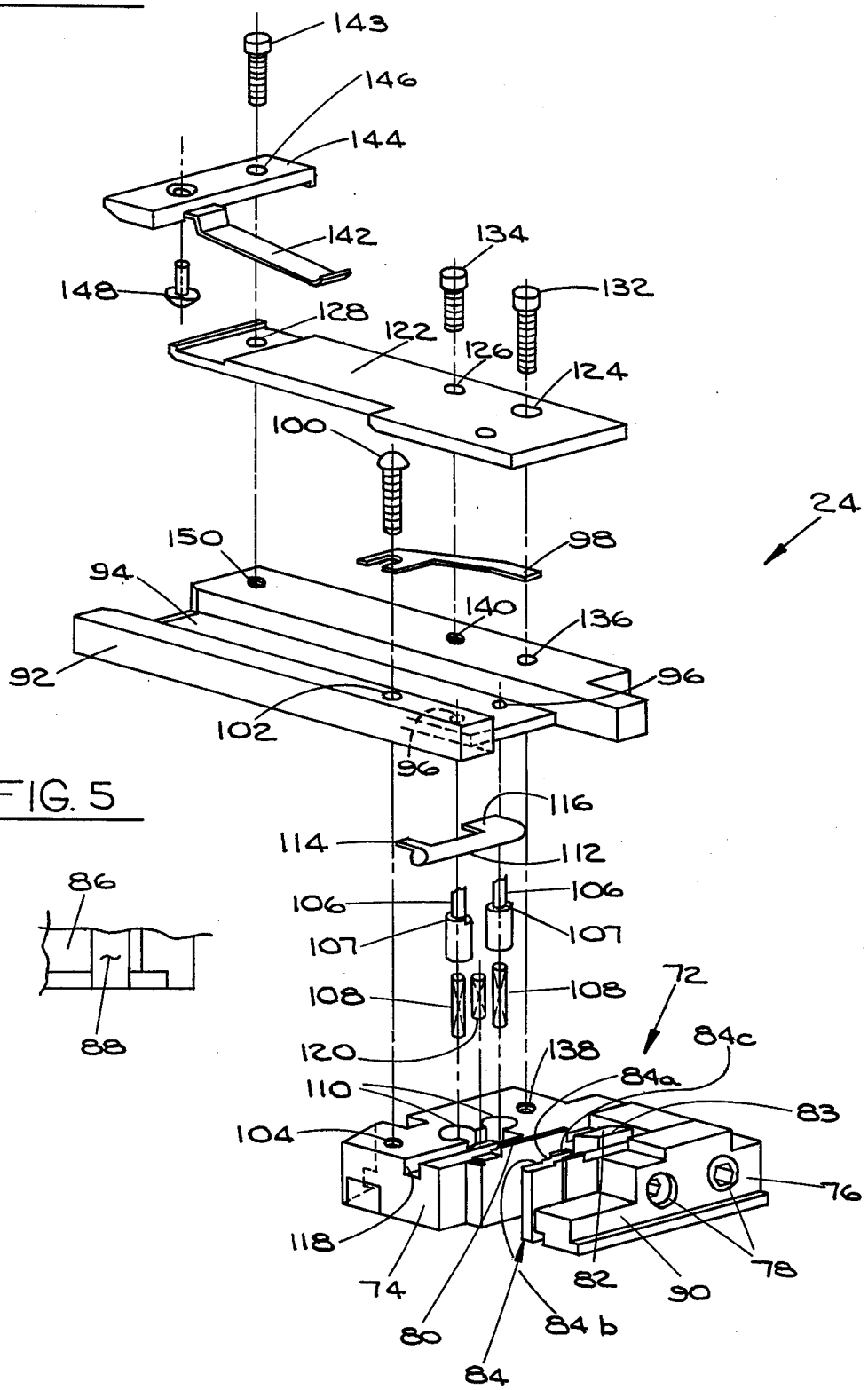
FIG. 4 is an exploded perspective view of the removable module assembly forming a part of the crimp die assembly of the present invention.
FIG. 5 is a side elevational view of the removable module assembly.

As is best seen in FIG. 4, the modular terminal support assembly 24 is seen to generally include a crimp station, generally designated 72 mounted between a retaining block 74 and another plate 76. The retaining block 74 is secured to the plate 76 by means of fastener 78.

The crimp station 72 defines the location where a stripped insulation clad wire lead is placed preparatory to crimping. In particular, the crimp station 72 is seen to include a cut-off blade 80 adjacent the retaining block 74 for cutting the terminal strip 15 between adjacent terminals 16 thereby separating a crimped terminal from the remainder of the strip. Mounted adjacent the cut-off blade 80 is a ramp configured spacer 82.

An anvil, generally designated 84 is mounted adjacent the spacer 82. The anvil 84 has two portions **84*a* and 84*b* serving as a conductor anvil and an insulation anvil, respectively. The upper edge 84*c* of the anvil 84 operates as a second cut-off blade to sever the carrier strip 18 immediately adjacent to the terminal 16 that is being crimped. The anvil is mounted against plate 76.**

The retaining block 74 has a surface 86 adapted to mate with surface 46 of the locking block 42. Surface 86 has a pin recess 88 formed therein for receiving the locating pin 44 therein when the pin 44 is in a locked or extended position. Plate 76 has a surface 90 which is adapted to mate with surface 52 of the locating bar 40.

Mounted above the retaining block 74 and adapted to overlie the locking assembly 38 is a terminal support plate 92. The terminal support plate 92 has a terminal track or channel 94 formed therein for receiving the terminal strip 15. The track 94 has two openings 96 formed therein. (FIG. 4).

A terminal hold-down leaf spring 98 is secured to the terminal support plate 92 by means of a fastener 100 for the purpose of holding the terminal strip 15 down after cut off and to bias the terminal strip 15 downwardly to lay on top of the crimp anvil 84. The fastener 100 is received through a hole 102 formed in the terminal support plate 92 and is secured into a hole 104 formed in the retaining block 74. (FIG. 4)

In order to properly index the terminal strip 15, means are provided to hold the strip at a given position preparatory to the crimping operation. To this end there is provided two vertical pins 106 having an inclined upper surface and shoulders formed approximately midway up the pin. The two pins 106 are mounted with springs 108 within two recesses 110 formed in block 74. A rotatable member 112 having a handle portion 114 and a pin engaging portion 116 is also mounted in block 74 within a rod recess 118 (FIG. 4). The handle portion 114 extends outside of the block 74 while the engaging portion 116 engages the shoulders 107 of pins 106. When the member 112 is rotated counterclockwise, the pins 106 are depressed against the force of springs 108 so that no portion of the pins 106 extend upwardly through the terminal track 94. While in this configuration, the terminal strip 15 can be pulled out of the crimp die assembly 10 if necessary.

The rotatable member 112 is normally in a position that allows the force of springs 108 to keep the pins above the surface of track 94. Thus, to provide a returning force to maintain the member 112 in its normal position, a spring 120 is provided between the two pins 106 which exerts an upward force on the rotatable member 112.

A terminal cover plate 122 having three openings, 124, 126 and 128, is mounted over the terminal support plate 92. The cover plate 122 is secured to the support plate 92 by means of fasteners 143 and 134. Fastener 143 is mounted through opening 124 in the cover plate 122, and through opening 136 in plate 92 and secured into opening 138 formed in block 74. The fastener 134 is mounted through the opening 126 in the cover plate 122 and is secured into opening 140 in plate 92.

Another terminal drag spring 142 is mounted by means of a fastener 148 onto a bracket 144.

The bracket 144 has an opening 146 for a fastener 143 which fastens the bracket 144 to the plate 122 through an opening 128 and is secured within opening 150 in terminal support plate 92. This terminal drag spring 142 also provides hold-down friction against the terminal strip 18.

A different modular support assembly 24 is provided for each different type of terminal. Accordingly, the terminal track 94 may be of a different width, the pins 106 may be spaced a different distance apart, the spacing between cut-off blades 80 and 83 may be different, and the configuration of the anvil 84 will also be different.

The modular assembly 24 is the only significant piece of non-perishable hardware in the crimp die assembly 10 which is changed upon the use of the different terminal. This cuts down on the capital expense a manufacturer requires in order to crimp a number of different type terminals.

IV. PUNCH ASSEMBLY

The punch assembly 26 is mounted on a frame assembly 22 over the crimp station 72 and is movable between a first position spaced from the crimp station (FIG. 1) to a second position engaging a wire lead and terminal at the crimp station 72 (FIG. 2) to effect the crimping operation. The punch assembly 26 includes the adapter 28 which is connected to the press 12.

Looking now to FIG. 3, the punch assembly 26 includes a punch housing, generally designated 156. The punch housing forms the base or foundation for the punch assembly 26.

Formed on the outside of the punch housing 156 are a pair of guide tracks 158. The guide tracks 158 are adapted to be slidingly received between the relief portion 54 and the gibs 56 of the frame assembly 22. When this is mounted, the punch housing 156 as well as the entire punch assembly 26 is slidingly movable upwardly and downwardly.

The punch housing 156 has a vertical channel 160 formed therein and a horizontal channel 162 formed transversely thereacross. Channels 160 and 162 are used for mounting components which will be discussed in greater detail hereinafter.

The punch housing 156 has a top surface 164 with a hole 166 formed therein. A top cover plate 168 is adapted to be mounted over the top surface 164. The top cover plate 168 has an opening 170 formed therein aligned with the hole 166 in the top surface 164 of the punch housing 156. The adapter 28 has a portion which is received through openings 166 and 170 to be secured in the punch housing 156.

The punch housing 156 also has a front surface 172 with two pair of holes, 174 and 176, respectively, formed therein. A plurality of punches are provided to be mounted within the punch housing 156 for movement therewith. In particular, the punches are mounted in the vertical channel 160 on a mounting pin 178.

The punches include a conductor punch 180 having a pin recess (not shown) formed therein, an insulation punch 184 having a pin recess 186 formed therein, and a cut-off punch 188. The conductor punch is adapted to strike the conductor crimp section of a terminal 16 supported over the conductor anvil 84*a*. The insulation punch 184 is adapted to engage the insulation crimp section of a terminal 16 supported over the insulation anvil 84*b*. Both punches 180 and 184 are mounted in the vertical channel 160 by having their respective recesses 182 and 186 receiving the mounting pin 178 therethrough.

A conductor crimp adjusting slide cam 190 is mounted in the horizontal cam channel 162 immediately above the conductor punch 180. The slide cam 190 is wedge-shape in configuration so that when the cam 190 is moved so that the thicker portion overlies the conductor punch 180, it will be disposed lower thereby effecting a lower crimp height.

In order to slide cam 190, an adjusting screw 194 engages cam 190. By turning the screw 194 in one direction or the other, the relative height of the conductor punch 180 can be changed. This would allow for crimping different gaged wires.

Mounted immediately adjacent the conductor crimp adjusting slide cam 190 is an insulation crimp adjusting slide cam 198 having a horizontal ridge 200 and a generally wedge-shaped, stepped bottom surface 202. Attached to the insulation crimp adjusting slide cam 198 is a manually manipulable pin 204 to slide cam 198 in either direction as will be explained in greater detail hereinafter. The insulation crimp adjusting slide cam 198 is mounted immediately above the insulation punch 184 for relatively raising or lowering the position thereof.

The insulation crimp adjusting slide cam 198 is mounted so that its horizontal ridge 200 is received in an elongated recess (not numbered, but shown in FIG. 3) formed in a top face plate 208. The top face plate is secured to the front surface 172 of the punch housing 156 by means of a pair of fasteners 210.

The top face plate 208 has a cut-out portion 212 through which the manually manipulated pin 204 extends outwardly. Associated with the cut-out portion 212, is indicia 214, corresponding with the location of the pin 204. By sliding the pin 204 within the cut-out portion 212, the insulation crimp adjusting slide cam 198 moves within the horizontal channel 162 presenting a different stepped surface 202 to the top of the insulation punch 184. Thus, by sliding pin 204, one is able to change the insulation crimp height so that different insulation thickness can be accommodated.

A bottom face plate 216 is secured to the front surface 172 of the punch housing 156 immediately below a top face plate 208 by means of a pair of fasteners 218 (only one shown in FIG. 3). The bottom face plate 216 serves to hold punches 180 and 184 within the vertical channel 160 in the manner set forth above.

A cam follower assembly, generally designated 220, is mounted on the side of the punch housing 156. The cam follower assembly 220 is adapted to engage a portion of the terminal feed assembly 30 to actuate the assembly in response to the movement of the punch assembly 26.

In particular, the cam follower assembly 220 generally includes a roller arm 222 mounted on the side of the punch housing 156 by means of a pair of fasteners 224. The roller arm 222 rotatably supports a cam roller 226 on a shaft 228 mounted thereon. The cam follower assembly 220 acts on the terminal feed assembly 30 in a manner to be discussed in greater detail hereinafter.

V. TERMINAL FEED ASSEMBLY

The terminal feed assembly 30 is associated between the punch assembly 26 and a strip of terminals 15 on the modular terminal support assembly 24. Everytime the punch assembly 26 moves downwardly, the terminal feed assembly 30 indexes the terminal strip 15 in a given increment forward toward the crimp station 72.

The terminal feed assembly 30 generally comprises a feed pawl assembly generally designated 232, and a feed cam assembly, generally designated 234. The feed pawl assembly directly engages the terminal strip 15 to move it along the terminal track 94. The feed cam assembly 234 engages the cam follower assembly 220 of the punch assembly 26 and is operably connected to the feed pawl assembly 232 to actuate it in response to the appropriate movement.

The feed pawl assembly 232 is seen to include a pawl member 236 having a forward tip or finger 238 which directly engages the terminal strip 18. The pawl member 236 has a stud opening 239 formed in about the middle thereof and a spring pin 240 formed near the free end thereof.

The feed cam assembly 234 is seen to generally include a forward feed cam 242 secured to a back feed cam 244 by means of a shaft 246. The shaft 246 provides a pivot point relative to the feed cams 242 and 244. The shaft 246 is mounted in the wall 36 of the frame assembly 22 in opening 60.

The forward feed cam 242 is mounted on the shaft 246 adjacent the wall 36. The forward feed cam 242 has an opening 248 having a shaft 246 extending outwardly therefrom.

A fastener 246 is secured in opening 251 in forward feed cam 242. The fastener 264 mounts the back feed cam in a manner which will be discussed in greater detail hereinafter.

The forward feed cam 242 is a generally planar surface with two spaced apart raised portions 252 and 254. Portion 252 acts as a stop lug and is adapted to engage upper stop pin 64 formed on wall 36. Raised portion 254 has a concave surface 256 facing a portion of the back feed cam 244. A spring pin 258 is formed on raised portion 252.

Back feed cam 244 is adapted to be mounted adjacent the forward feed cam 242 between the raised portions 252 and 254 thereof. Back feed cam 244 has an opening 260 alignable with the opening 248 on the forward feed cam 242 so that the shaft 246 can be received therethrough.

A radial slot 262 is formed in the back feed cam 244 to receive the fastener 264 therethrough. The fastener 264 is applied through radial slot 262 into an opening 251 of forward feed cam 242 so that the friction fit between feed cam 242 and feed cam 244 can be loosened or tightened to provide adjustability.

A stud opening 266 (FIG. 3) is formed in the bottom of the back feed cam 244 to receive a stud 268. Stud 268 extends through oblong opening 62 in the wall 36 of the frame assembly 22 and also mounts pawl member 236 at the other end thereof. The pawl member 236 is mounted so that it is pivotable relative to the back feed cam 244.

The surfaces 270 and 271 on the back feed cam 244 and forward feed cam 242, respectively, adjacent the cam roller assembly 220 define cam surfaces. Cam surfaces 270 and 271 are adapted to engage the cam roller 226. As the cam roller moves up and down due to a movement of the punch assembly 26, its engagement against cam surfaces 270 an 271 causes the whole feed cam assembly 234 to pivot about shaft 246 as is best shown in FIGS. 1 and 2.

In order to change the amount of rotation of the cam assembly 234 about shaft 246 and therefore change the incremental movement of the pawl member 236, back cam 244 is provided with a thick portion 272 intermediate the raised portions 252 and 254 of the forward feed cam 242. The thick portion 272 has a jack screw 274 threaded therethrough so that the end thereof engages the concave surface 256 formed on raised portion 254 of the forward feed cam 242. By loosening fastener 264 and then rotating jackscrew 274 in either direction, one is able to adjust the feed distance of the terminal feed assembly 30. After the adjustment is made, fastener 264 is retightened.

Back feed cam 244 is also provided with two spring pins 276 and 278. A first spring 280 is mounted between spring pin 276 and spring pin 240 on the pawl member 236. A second spring 282 is mounted between spring pin 278 on the back feed cam 244 and spring pin 258 on the forward feed cam 242. Springs 280 and 282 serve to keep the components of the terminal feed assembly 30 in their proper relationship and to aid in returning the components to a normal position.

The pawl member 236 can be changed when crimping different terminals. This may be necessary because of the terminal progression and/or the configuration of the particular terminal.

VI. OPERATION

Turning now to FIGS. 1 and 2, the operation of the crimp die assembly 10 is shown. First, the crimp die assembly 10 is mounted on a bench press 12 in the conventional manner. Then, the appropriate conductor and insulation punches, 180 and 184, respectively, are mounted in the punch assembly 26. After the punches are mounted, the appropriate modular terminal support assembly 24 is mounted on the frame assembly 22 in the manner above described.

The adjustments to the conductor crimp height or the insulation crimp height are made by manipulating adjusting screw 194 or sliding pin 204, respectively.

A terminal strip 15 is positioned in the terminal track 94 so that pins 106 engage the terminal strip 15. The terminal strip 15 can be pulled toward the crimp station 72 until the first terminal 16 overlies the anvil 84. When the terminal strip 15 is thus mounted, it cannot be pulled backwards through the terminal track 94 unless member 112 is rotated to depress pins 106 as above described.

Depending on the progression of the terminal strip 15, the terminal feed assembly 30 is adjusted by turning the jack screw 274. This will determine the stroke of the pawl member 236.

The crimp die assembly 10 is now ready for operation. The operator then places a strip insulation clad wire lead in the unformed terminal 16 at the crimp station 72. This configuration is depicted in FIG. 1.

The press 12 is then actuated by the operator in the conventional manner causing the crimp die assembly 10 to assume the configuration shown in FIG. 2. During the movement between FIG. 1 and FIG. 2, the punch assembly 26 through the cam follower assembly 220 engages the feed cam assembly 234 to move the pawl member 236 away from the crimp station 72. At the same time, the terminal 16 is cut from the carrier strip 18 and formed about the wire lead 16 in the conventional manner.

At the end of the crimping operation, the punch assembly 26 is moved upwardly by the press 12 and the movement of the feed cam assembly 234 is in an opposite direction. During this movement, the pawl member 36 moves toward the crimp station 72 after engaging the terminal strip 15. This movement has been calibrated to equal the progression of the terminal strip 15 and will feed the next successive terminal to the crimp station 72 for another crimping operation.

If it is desired to use the same crimp die assembly 10 with another terminal having a different configuration and progression, the operator need only replace the modular terminal support assembly 24, mount new punches 180, 184 and 188 in the punch assembly 26, adjust for the insulation and conductor crimp heights, adjust the terminal feed assembly 30 for the new progression, and, perhaps mount a new pawl member 236. This eliminates the need of purchasing and maintaining a whole new crimp die assembly.

We claim:

1. In a crimp die assembly adapted to be mounted in a press for crimping terminals formed on a carrier strip and spaced a given distance from one another onto stripped insulation clad wire leads, said crimp die assembly comprising:

a frame assembly including module mounting means for locating and locking one of a plurality of terminal module assemblies onto said frame assembly;

one of a plurality of different integral terminal module assemblies removably mounted on said base, each terminal module assembly having a crimp station whereat a terminal is crimped onto a wire lead, said crimp station including an insulation anvil and a conductor anvil, a different crimp station adapted to crimp a different styled terminal;

a punch assembly slidably mounted on the frame assembly facing said crimp station and operably connected to the press for reciprocal movement toward and away from said crimp station, said punch assembly including an insulation punch and a conductor punch adapted to engage a wire lead and terminal at the crimp station; and an adjustable terminal feed assembly associated between said punch assembly and said terminal strip for feeding the strip of terminals one at a time to the crimp station in response to the movement of the punch assembly.

2. The crimp die assembly of claim 1 wherein said terminal feed assembly includes a pawl member movable to engage and disengage the terminal strip to transport the strip of terminals on the modular terminal support assembly a given incremental distance after each crimping operation so that successive terminals are presented one at a time to the crimp area, and an adjustable cam assembly operably associated between the punch assembly and the pawl member for moving the pawl member in response to the movement of the punch assembly, said cam assembly having means for changing the relative configuration thereof which changes the incremental distance of the pawl member movement.

3. The crimp die assembly of claim 2 wherein the cam assembly includes a first cam member associated with said pawl member and a second cam member associated with the punch assembly, said first and second cam members being adjustably secured to one another.

4. The crimp die assembly of claim 1 wherein said punch assembly includes means for adjusting the insulation crimp height and means for adjusting the conductor crimp height.

5. The crimp die assembly of claim 4 wherein said insulation crimp adjusting means includes a slide cam mounted above and movable transversely relative to the insulation punch, said insulation punch being moved upwardly or downwardly in response to the transverse movement of said insulation crimp adjusting slide cam.

6. The crimp die assembly of claim 4 wherein said means for adjusting the conductor crimp height includes a slide cam mounted above and movable transversely relative to said conductor punch, said conductor punch being moved upwardly or downwardly in response to the transverse movement of the conductor crimp adjusting slide cam.

7. The crimp die assembly of claim 1 wherein said module mounting means includes a module locating bar mounted on the frame assembly, a module locking assembly mounted on the frame assembly spaced from the locating bar, said terminal module assembly being mountable between said locating bar and said locking assembly, said locking assembly including a locating pin selectively movable between a retracted position within said assembly and an extended position toward the locating bar.

8. The crimp die assembly of claim 7 wherein said terminal module assembly includes a recess for receiving the locating pins in the extended position.

9. In a crimp die assembly adapted to be mounted in a press for crimping terminals formed on a carrier strip and spaced a given distance from one another onto stripped insulated wire leads, said crimp die including a base with a terminal supporting structure for supporting the strip of terminals, said supporting structure having a crimp station whereat a terminal is crimped onto a wire lead, a punch assembly opposite said crimp station and operably connected to said press for reciprocal movement toward and away from said crimp station so that a portion thereof engages a wire lead and terminal at the crimp station, and a terminal feed assembly associated between said punch assembly and said terminals for feeding the strip of terminals one at a time to the crimp station in response to the movement of the punch assembly, the improvement in said terminal feed assembly comprising:

pawl means movable in a sequence from a first position above said terminal strip to a second position engaging said strip away from the crimp area to a third position closer to said crimp area moving said strip therewith, and back to said first position, the distance between said second and third positions being equal to the progression distance between adjacent terminals on the strip so that successive terminals are presented to the crimp area; and an adjustable cam assembly operably associated between said punch assembly and said pawl means for moving said pawl means in response to the movement of the punch assembly, said cam assembly including a first cam member associated with said pawl means and a second cam member associated with said punch assembly, said first and second cam members being adjustably secured to one another for changing the relative configuration thereof which changes the distance of the pawl means movement between its second and third positions to accomodate different terminal strips.

10. In a crimp die adapted to be mounted in a press for crimping terminals onto stripped insulated wire leads, said crimp die including a base with a terminal supporting structure for supporting a plurality of terminals, said supporting structure having a crimp station whereat a terminal is crimped onto a wire lead, said crimp station including an insulation anvil and a conductor anvil, a punch assembly opposite said crimp station and operably connected to said press for reciprocal movement toward and away from said crimp station, said punch assembly including an insulation punch and a conductor punch adapted to engage a wire lead and terminal at the crimp station, and a terminal feed assembly associated between said punch assembly and said terminals for feeding a plurality of terminals one at a time to the crimp station in response to the movement of the punch assembly, the improvement in said terminal supporting structure comprising:

one of a plurality of different integral terminal module assemblies removably mounted on said base, each module assembly having a different crimp station adapted to crimp a different styled terminal; and means for locating and locking one of said terminal module assemblies onto the base.

11. The crimp die of claim 10 wherein said locating and locking means includes a module locating bar mounted on said base;

a module locating block assembly mounted on said base spaced from said locating bar, each terminal module assembly being mountable between said bar and block assembly, said locating block assembly including a locating pin selectively movable between a retracted position within the locating block assembly and an extended position outside the block assembly and toward the locating bar; and each terminal module assembly including a recess for receiving the locating pin when the pin is in the extended position.

* * * * *